US010238918B1

(12) United States Patent
Huot

(10) Patent No.: US 10,238,918 B1
(45) Date of Patent: Mar. 26, 2019

(54) PLATFORM-AGNOSTIC AVALANCHE AIRBAG ATTACHMENT SYSTEM

(71) Applicant: Raymond Eugene Huot, Anchorage, AK (US)

(72) Inventor: Raymond Eugene Huot, Anchorage, AK (US)

( * ) Notice: Subject to any disclaimer, the term of this patent is extended or adjusted under 35 U.S.C. 154(b) by 0 days.

(21) Appl. No.: 15/961,066

(22) Filed: Apr. 24, 2018

(51) Int. Cl.
*A63B 29/02* (2006.01)

(52) U.S. Cl.
CPC ..... *A63B 29/021* (2013.01)

(58) Field of Classification Search
CPC ..... A63B 29/021; A63B 29/022
See application file for complete search history.

(56) References Cited

U.S. PATENT DOCUMENTS 4,365,628 A * 12/1982 Hodel ..... A62B 7/02 128/205.12
6,158,380 A * 12/2000 Aschauer ..... A62B 33/00 116/210
6,220,909 B1 * 4/2001 Aschauer ..... A62B 33/00 441/136
6,270,386 B1 * 8/2001 Visocekas ..... A41D 13/018 441/104
7,270,077 B2 * 9/2007 Beck ..... A62B 33/00 116/209
7,824,239 B2 * 11/2010 Weinel ..... A62B 33/00 441/114
7,878,141 B2 2/2011 Paynton et al.
8,851,948 B2 * 10/2014 Grutta ..... A62B 33/00 116/210
9,289,633 B2 * 3/2016 Walker ..... A62B 33/00
9,585,425 B2 * 3/2017 Berchten ..... A62B 33/00
9,814,938 B2 * 11/2017 Schaer ..... A62B 33/00
2006/0107952 A1 * 5/2006 Schlosser ..... A41D 13/018 128/202.19
2009/0239428 A1 * 9/2009 Berchten ..... A62B 33/00 441/80
2010/0184343 A1 * 7/2010 Paynton ..... A62B 33/00 441/90
2010/0255809 A1 * 10/2010 Aschauer ..... A62B 99/00 455/404.2

(Continued)

OTHER PUBLICATIONS

McCoy, S., "Jacket Intergrates Avalanche Airbag System," Skiing Snowboarding Winter, https://gearjunkie.com/subq-designs-jackson-jacket-abs-avalanche-airbag, Dec. 11, 2015, 11 pages.

(Continued)

*Primary Examiner* — S. Joseph Morano
*Assistant Examiner* — Jovon E Hayes

(57) ABSTRACT

A platform-agnostic buoyancy aid includes a bladder having a direction of inflation, an inflator coupled to the bladder and configured to fill the bladder with a gas in response to actuation by a trigger, a trigger connected to the inflator and configured to actuate the inflator in response to a tension applied to a ripcord, and a removable directional attachment rig holding the bladder, inflator and trigger, the removable directional attachment rig configured to attach the buoyancy aid to at least one of a wearer's backpack, clothing or harness such that the relative angle of the direction of inflation of the bladder to the wearer's centerline remains substantially constant.

20 Claims, 12 Drawing Sheets

(56) References Cited

U.S. PATENT DOCUMENTS

| | | | | |
|---|---|---|---|---|
| 2013/0019994 | A1* | 1/2013 | Schaer | C06D 5/02 141/313 |
| 2016/0000158 | A1* | 1/2016 | Davis | A63B 69/18 2/455 |
| 2016/0016045 | A1* | 1/2016 | Rose | B63C 9/155 441/114 |
| 2017/0274229 | A1* | 9/2017 | Werz | A62B 33/00 |
| 2017/0368385 | A1* | 12/2017 | Werz | A63B 29/021 |
| 2018/0078823 | A1* | 3/2018 | Wieczorek | A62B 33/00 |

OTHER PUBLICATIONS

"Modulator ABS," The North Face, https://www.thenorthface.com/shop/modulator-abs-clh4, Nov. 19, 2017, 3 pages.

Flitern; Avalanche Airbags; https://us.mammut.com/cat/3041/avalanche-airbags;date Jan. 3, 2018; 3 pages.

* cited by examiner

PLATFORM-AGNOSTIC AVALANCHE AIRBAG ATTACHMENT SYSTEM

TECHNICAL FIELD

This disclosure relates generally to buoyancy aids. More specifically, this disclosure relates to a platform-agnostic avalanche airbag attachment system.

BACKGROUND

Beyond the athletic rigors inherent to backcountry winter sports (for example, mountaineering, ice climbing, or heli-skiing) the challenges of such pastimes include, without limitation, the risk of avalanches, and the logistical issues associated with carrying the necessary gear in a way that permits quick access to safety gear (for example, avalanche airbags and beacons), and at the same time, distributes the weight and volume of the gear in a manner that does not impair the wearer's balance and range of motion. Much mountaineering safety gear is platform-specific, in the sense that the safety equipment comprises an integral component of a specific backpack or family of backpacks. As such, practitioners of backcountry winter sports may be presented with the unpalatable choice between a pack which includes an airbag system but falls short in terms of providing the necessary weight distribution and comfort for a given application, or a better-performing pack which lacks an avalanche airbag system. For example, a user may wear a relatively small, form-fitting pack optimized for backcountry skiing or snowboarding, and a larger pack optimized for trekking or mountaineering. Packs with integrated avalanche airbag systems may be unsuitable for both skiing and mountaineering. Additionally, packs with integrated airbag systems may not provide users with the option of carrying multiple avalanche airbags, thereby denying users of the added security of a backup airbag, in case one airbag fails to inflate, or the user cannot reach the trigger for the airbag.

SUMMARY

This disclosure provides a platform-agnostic avalanche airbag attachment system.

In a first embodiment, a platform-agnostic buoyancy aid includes a bladder having a direction of inflation, an inflator coupled to the bladder and configured to fill the bladder with a gas in response to actuation by a trigger, a trigger connected to the inflator and configured to actuate the inflator in response to a tension applied to a ripcord, and a removable directional attachment rig holding the bladder, inflator and trigger, the removable directional attachment rig configured to attach the buoyancy aid to at least one of a wearer's backpack, clothing or harness such that the relative angle of the direction of inflation of the bladder to the wearer's centerline remains substantially constant.

In a second embodiment, a directional attachment rig for an inflatable bladder includes a compartment comprising an anchor for an inflatable bladder and an opening disposed away from the anchor for the inflatable bladder, a trigger portal, and a directional sleeve having a centerline that remains at a substantially constant angle relative to the direction of inflation of the inflatable bladder. According to various embodiments, the term "an opening disposed away from the anchor for the inflatable bladder" encompasses structures which yield and provide substantially unimpeded passage to an inflating bladder which is expanding in the direction of inflation.

In a third embodiment, a directional attachment rig includes a compartment comprising an anchor for an inflatable bladder and an opening disposed away from the airbag anchor, a trigger portal and an attachment anchor disposed along a line that remains at a substantially constant angle relative to the direction of inflation of the inflatable bladder.

Other technical features may be readily apparent to one skilled in the art from the following figures, descriptions, and claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 10, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged wireless communication system.

Figure 1:
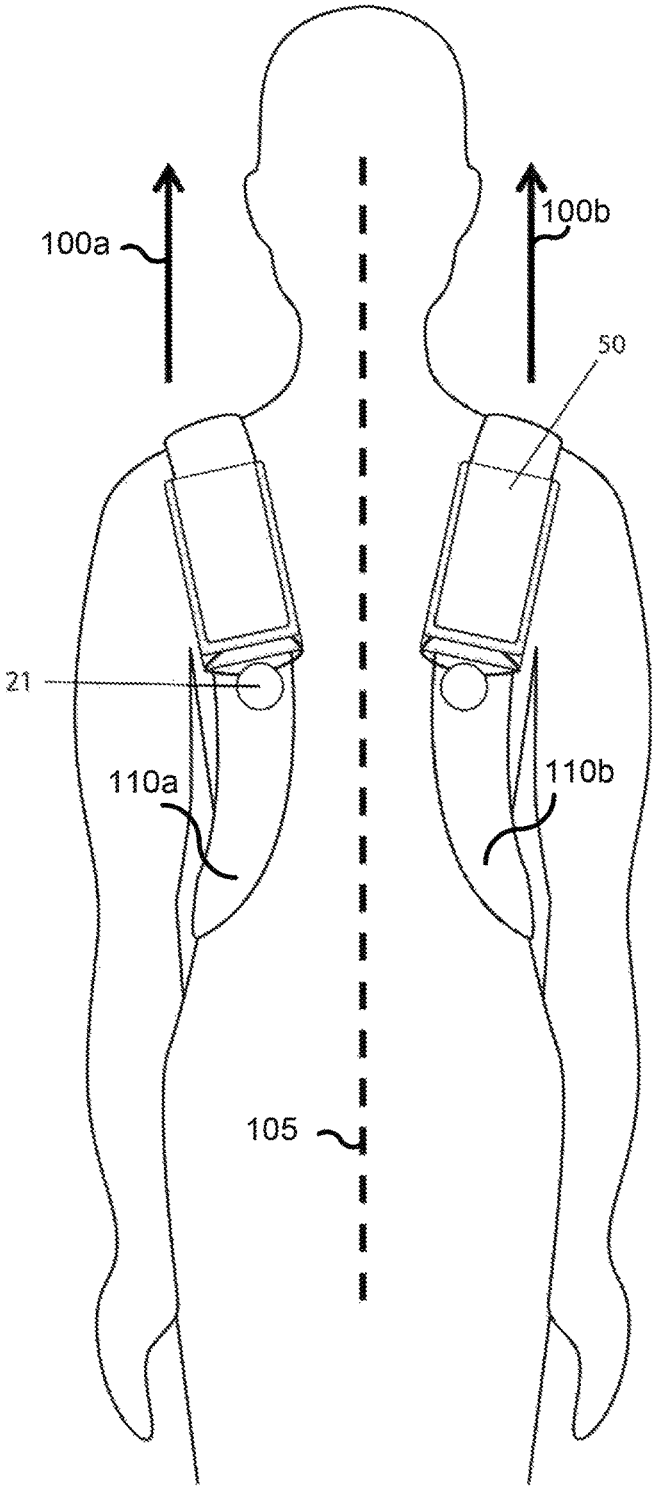
FIG. 1 illustrates an example of a platform-agnostic buoyancy aid according to certain embodiments of this disclosure mounted on the straps of a wearer's backpack.

FIG. 1 illustrates an example of a platform-agnostic buoyancy aid 50 according to certain embodiments of this disclosure. In the non-limiting example of FIG. 1, platform-agnostic buoyancy aid 50 is one of a pair of platform-agnostic buoyancy aids attached to shoulder straps 110*a* and 110*b* of a wearer's backpack. According to certain embodiments, in the event of an avalanche, or other situation presenting a drowning or suffocation risk (for example, a fall into water, sand, grain or other loose media) the user triggers the buoyancy aid by pulling on a handle 21 connected to a trigger for an inflator for an inflatable bladder (for example, an airbag) contained within each platform-agnostic buoyancy aid 50. In response to the user's pull on handle 21, for each platform-agnostic buoyancy aid 50, a bladder attached to each platform-agnostic buoyancy aid 50 inflates. According to embodiments, each bladder inflates outwards, with the bladder attached to the buoyancy aid mounted on strap 110*a* inflating in direction 100*a*, and the bladder attached to the buoyancy aid mounted on strap 110*b* inflating in direction 110*b*.

According to certain embodiments, the performance of platform-agnostic buoyancy aid 50 can be enhanced by ensuring that the direction of inflation of the bladder remain at a substantially constant angle relative to a reference line, such as the centerline 105 of a wearer. For example, in embodiments where platform-agnostic buoyancy aid 50 is intended to protect the wearer in the event of being trapped in an avalanche, it may be advantageous to ensure that the inflatable bladder of each buoyancy aid inflate towards the wearer's head, in order to shield the wearer from rocks and debris in the falling snow and to improve the likelihood that the wearer's head is above the snow, or at a minimum, is as close as possible to the surface of the snow.

In the non-limiting example of FIG. 1, platform-agnostic buoyancy aid 50 is shown as being attached to shoulder straps 110*a* and 110*b* of a pack. According to embodiments, platform-agnostic buoyancy aid 50 can be removed from one pack and mounted on the shoulder straps of another pack or harness. According to other embodiments, platform-agnostic buoyancy aid 50 can be mounted on an article of clothing, such as a vest. According to still further embodiments, platform-agnostic buoyancy aid 50 can be attached to a pack, harness or article of clothing using one or more attachment mechanisms, including, without limitation, a directional sleeve, a tethered attachment anchor or a surface anchor.

Figure 2:
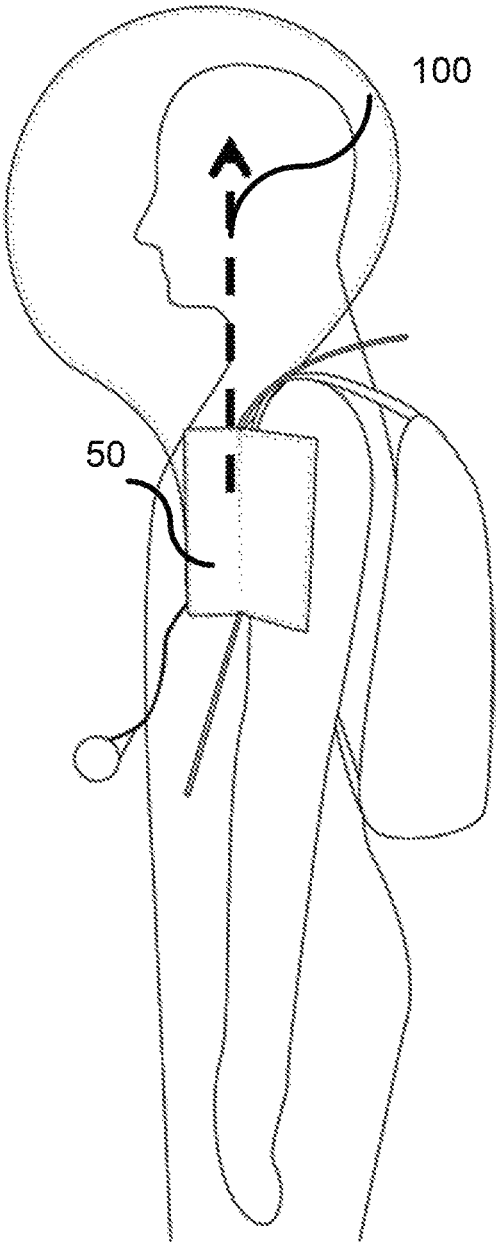
FIG. 2 illustrates an example of a platform-agnostic buoyancy aid according to certain embodiments of this disclosure in an inflated state.

FIG. 2 illustrates an example of platform-agnostic buoyancy aid 50 according to certain embodiments of this disclosure in a deployed state. As noted herein, according to some embodiments, the performance of platform-agnostic buoyancy aid 50 can be enhanced when the bladder is inflated in an intended direction of inflation 100. In the non-limiting example of FIG. 2, the direction of inflation 100 is upwards, towards the user's head. The direction of inflation may be expressed as a line connecting a first reference point of the bladder in its uninflated state (for example the point at which the bladder is attached to an inflator) with a second reference point of the bladder in its inflated state (for example, the centroid of the inflated bladder, or the topmost point of the bladder).

Figure 3:
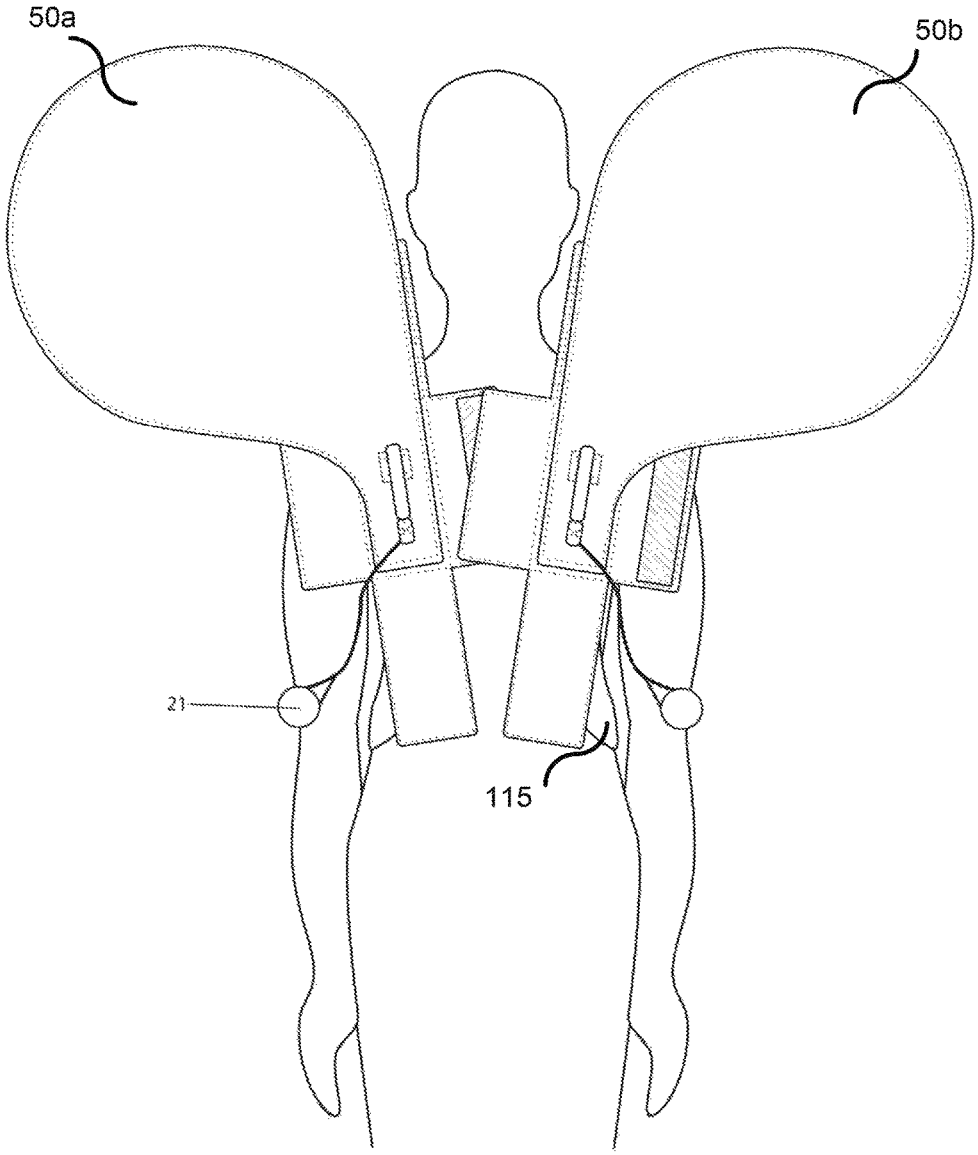
FIG. 3 illustrates an example of a platform-agnostic buoyancy aid according to various embodiments of this disclosure in an inflated state.

FIG. 3 illustrates an example of a pair of platform-agnostic buoyancy aids 50*a* & 50*b* according to certain embodiments, in an inflated state. As shown in the non-limiting example of FIG. 3, platform-agnostic buoyancy aids are shown in an inflated state (in this case, due to actuation of a trigger by the user pulling on handle 21) and as being attached to the rear side of a harness 115. Depending on the user's requirements, rear attachment of platform-agnostic buoyancy aids 50*a* & 50*b* may be preferable to front attachment, and embodiments according to this disclosure may support multiple modes of attachment to a harness, pack or other platform.

Figure 4:
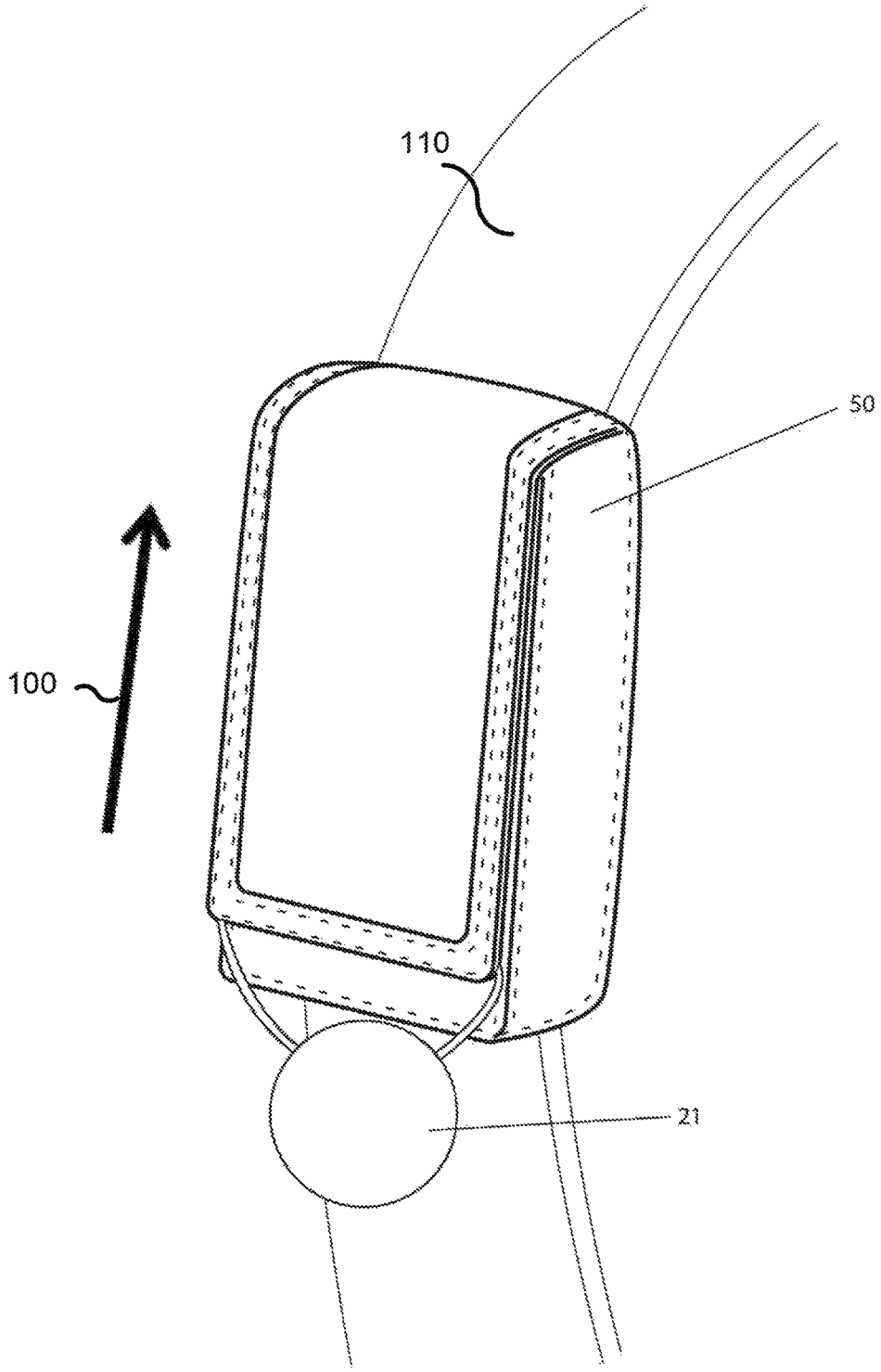
FIG. 4 illustrates an example of a platform-agnostic buoyancy aid according to some embodiments of this disclosure.

FIG. 4 illustrates an example of a platform-agnostic buoyancy aid 50 according to certain embodiments of this disclosure. In the non-limiting example of FIG. 4, platform-agnostic buoyancy aid 50 is attached to a shoulder strap 110 via a surface mount such that the direction of inflation 100 of the bladder of the platform-agnostic buoyancy aid 50 remains at a sufficiently constant angle relative to a reference line (for example, the centerline of the wearer's body or the direction of strap 110 to ensure that the bladder inflates in an upward direction, where the inflated bladder can shield the user's head and create an air pocket in the snow. In the non-limiting example of FIG. 4, the bladder is inflated in response to a user pulling downward on a ripcord via handle 21. By pulling downward, the user causes the bladder to inflate upwards, thereby ensuring that the user's hand will not interfere with the inflation of the bladder.

Figure 5:
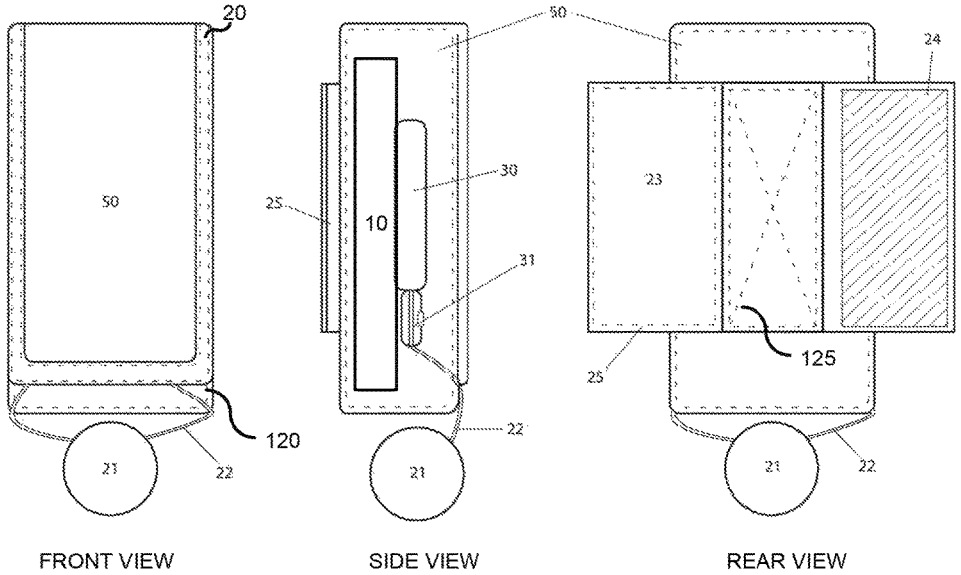
FIG. 5 illustrates three views of a platform-agnostic buoyancy aid according to some embodiments of this disclosure according to this disclosure.

FIG. 5 illustrates a front view, a side view and a rear view of a platform-agnostic buoyancy aid 50 according to certain embodiments of this disclosure.

According to certain embodiments, platform-agnostic buoyancy aid 50 comprises a bladder 10, an inflator 30, a trigger 31, a ripcord 22, a handle 21, and a removable directional attachment rig 20.

In the non-limiting example of FIG. 5, bladder 10 is a vessel of air impermeable material having one or more airtight passages through which a buoyant medium (for example, a gas such as carbon dioxide ($CO_2$), compressed air or nitrogen) moves from one or more inflators to fill the bladder. According to various embodiments, bladder 10 is constructed of a durable, air impermeable material which remains pliable and inflatable at temperatures below freezing. Suitable materials for bladder 10 include, without limitation, vinyl, or treated 200 denier nylon.

According to some embodiments, bladder 10 is connected to inflator 30, which provides the gas to fill bladder 10 in response to a user's actuation of trigger 31. In the non-limiting example of FIG. 5, inflator 30 is a threaded cylinder cartridge containing 24-38 grams of $CO_2$. In other embodiments, bladder 10 may be inflated with gases generated from an explosive or combustive process (similar to an automobile airbag). In such embodiments, inflator 30 comprises a container suitable for the storage and rapid combustion of a fuel material, such as sodium azide. In still further embodiments, inflator 30 may be a refillable gas canister.

In some embodiments, according to this disclosure, trigger 31 attaches to inflator 30 and functions to trigger the passage of gas from inflator 30 to bladder 10. In the non-limiting example of FIG. 5, trigger 31 is a mechanical trigger, such as a Halkey-Roberts® inflator, which operates by puncturing a thin metal seal near the attachment threads of a $CO_2$ cartridge in response to a user applying sufficient tension to a lanyard or ripcord, causing carbon dioxide to rush from the cylinder, through a manifold and into bladder 10. In other embodiments, trigger 31 may be a mechanically or electronically actuated valve which opens in response to a user pressing a button or twisting an easy-to-grab collar. In still further embodiments, such as, for example, embodiments wherein inflator 30 comprises a sodium-azide free inflator (for example, a heated gas inflator (HGI) using a hydrogen-oxygen blend), trigger 31 may comprise an electronically controlled heating element for causing the ignition of the hydrogen-oxygen blend.

In the non-limiting example of FIG. 5, trigger 31 is actuated by a ripcord 22. According to various embodiments, ripcord 22 may be a piece of parachute cord or other durable material capable of maintaining tensile strength and pliability in cold temperatures. In some further embodiments, a handle, such as a grab ball or "T" handle 21 may be attached to ripcord 22 to make activating the ripcord more readily locatable in deep snow or easier to pull while wearing gloves or mittens.

According to various embodiments, bladder 10 is anchored, either directly or indirectly (for example, through inflator 30 or trigger 31) to a removable directional attachment rig 20 which attaches platform-agnostic buoyancy aid 51 to a platform such as a pack, harness or article of clothing.

Figure 6:
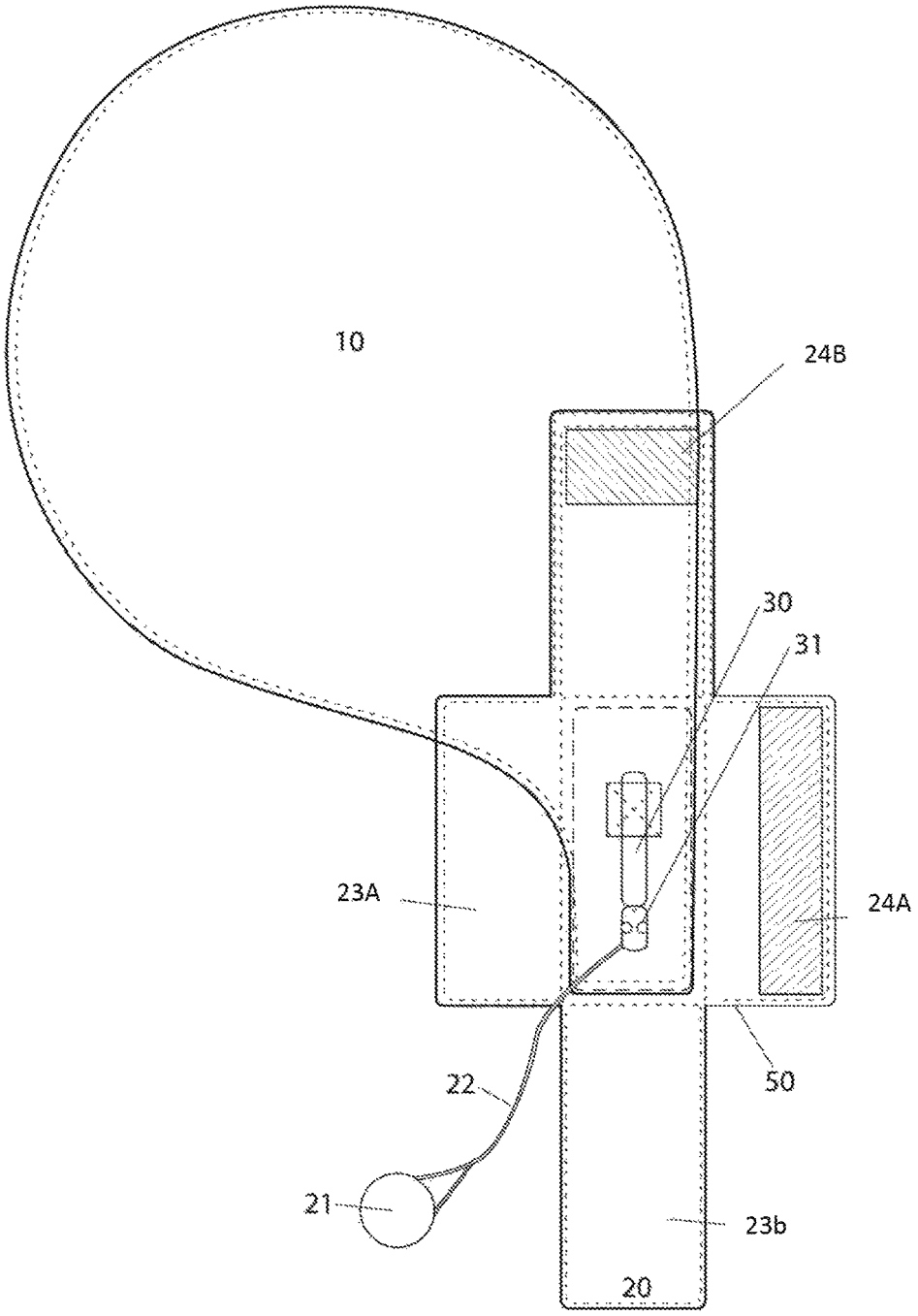
FIG. 6 illustrates a platform-agnostic buoyancy aid according to various embodiments of this disclosure.

As shown in the non-limiting example of FIG. 5, removable directional attachment rig 20 may comprise a cruciform piece of material defining a compartment (also shown in FIG. 6), and an anchor 25. The cruciform piece of material may, according to certain embodiments be made in whole or in part of any suitable material (including, without limitation, ripstop nylon, leather, polyester webbing, canvas sailcloth or Cordura® Nylon) which has sufficient pliability to go from defining a closed compartment (for example, as shown in FIG. 5) to providing a substantially clear path (for example, an opening) along which the bladder can fill and expand in the direction of inflation. Further, suitable materials have sufficient strength and sheer resistance to keep the bladder anchored to removable directional attachment rig 20, and keep removable directional attachment rig 20 attached to the platform. The cruciform shape shown in FIG. 6 is purely illustrative, and other embodiments are within the intended scope of this disclosure. For example, according to some other embodiments, the compartment portion of removable directional attachment rig 20 may have a "Kleenex® box" shape comprising a soft pouch with a wide slit through which bladder 10 can inflate outwards.

Additionally, according to some embodiments, removable directional attachment rig 20 comprises a trigger portal 120. In the non-limiting example of FIGS. 5 & 6, trigger portal 120 comprises a passage between the interior and exterior of removable directional attachment rig 20 created through which ripcord 22 passes. According to certain other embodiments, trigger portal 120 comprises a reinforced (such as with a metal eyelet or with buttonhole stitching) hole through which a ripcord, button, or other actuator of trigger 31 may be accessed from the exterior of removable directional attachment rig 20.

As noted above, removable directional attachment rig 20 further comprises an anchor 25 for securing the in a way that substantially resists torsional motion and maintains a substantially constant angle between the direction of inflation of bladder 10 and a wearer- or platform-defined reference line (for example, the wearer's centerline, as shown in FIG. 1).

In the non-limiting example of FIG. 5, anchor 25 comprises a directional sleeve. In the illustrative example of FIG. 5, anchor 25 is a directional sleeve formed by the attachment of first half 23 to second half 24. As shown in FIG. 5, anchor 25 is incorporated into removable directional attachment rig 20 through x-shaped stitching 125. In other embodiments, anchor 25 and the compartment portion of removable directional attachment rig 20 may be formed from a single piece of a suitable material (including, without limitation, ripstop nylon, leather, polyester webbing, canvas sailcloth or Cordura® Nylon), or multiple pieces of material stitched together or joined using other attachment techniques, such as rivets or adhesive. As shown in FIG. 5, when fastened to each other (for example, using Velcro®, a zipper or lacing), the first half 23 and second half 24 of anchor 25 define a sleeve through which the strap of a pack or portion of a harness can pass and be maintained at a substantially constant angle relative to a reference line of a wearer or an attachment platform. In this way, removable directional attachment rig 20 can store bladder 10 in a way that assures that it inflates in an intended direction (for example, towards the user's head, to better protect the wearer from debris in fast-sliding snow).

While not shown in FIG. 5, according to certain embodiments, an avalanche beacon may also be contained within removable directional attachment rig 20. In some embodiments, the avalanche beacon may be actuated by trigger 31 and/or ripcord 22, meaning that, when a user triggers the inflation of bladder 10, they also turn on the avalanche beacon. According to such embodiments, the user may not be required to separately activate the avalanche beacon, thereby enhancing the user's safety, for example in cases in which her arms are trapped in snow, or she has been knocked unconscious by debris in the snow slide.

FIG. 6 illustrates a platform-agnostic buoyancy aid 50 according to various embodiments of this disclosure as viewed in an opened state with bladder 10 fully inflated. As emphasized in the view provided in FIG. 6, removable attachment rig 20 includes a compartment formed from a cruciform piece of material. As shown in FIG. 6, the compartment is formed by folding and optionally joining (such as with a hook-and-loop pair having sufficient strength to stay together under ordinary use, but weak enough to readily yield to bladder 10 as it inflates) a first pair of halves 23A and 24A over bladder 10, inflator 30 and trigger 31, and subsequently joining a second pair of halves 23B and 24B using a fastening mechanism (for example, snaps) strong enough to hold together under ordinary use, but weak enough to readily yield to pressure exerted by inflating bladder 10. According to the non-limiting example of FIG. 6, halves 23A and 23B are shaped such that the region of their union leaves a passage, or trigger portal, through which ripcord 22 can pass from the exterior of removable directional attachment rig 20 to trigger 31.

Figure 7:
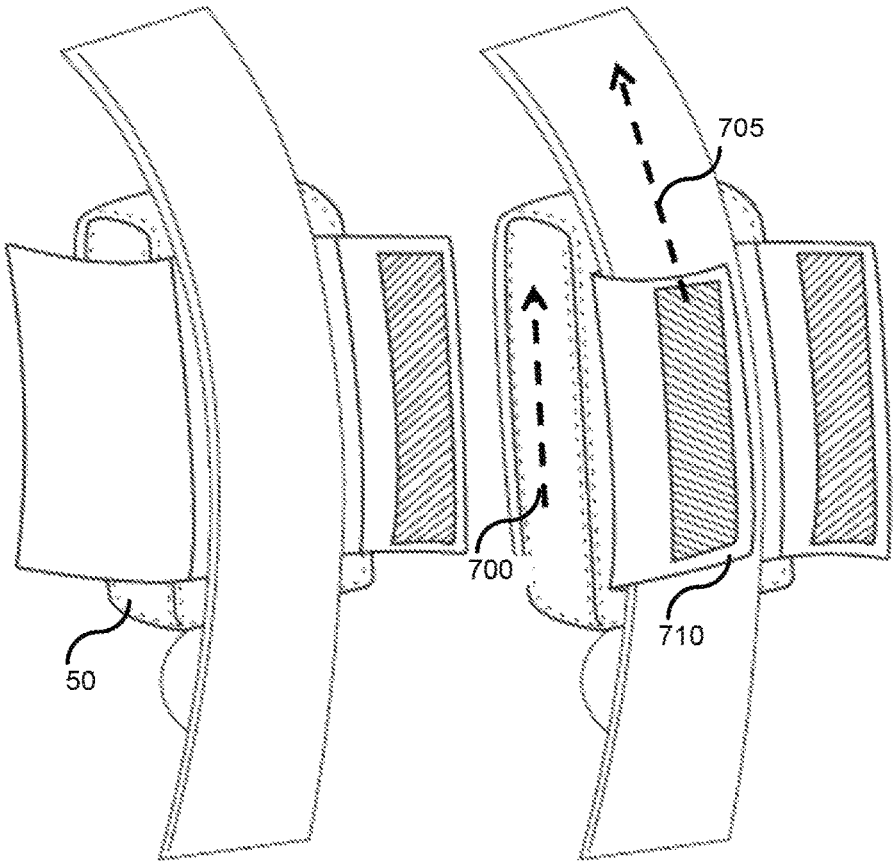
FIG. 7 illustrates two views of a platform-agnostic buoyancy aid according to certain embodiments of this disclosure.

FIG. 7 illustrates two views of a platform-agnostic buoyancy aid 50 comprising an inflatable bladder (not visible in the figure) and a removable directional attachment rig which is anchored to a platform (in this example, the shoulder strap of a pack or a harness) with a directional sleeve 710. As shown in the non-limiting example of FIG. 7, the direction of inflation 700 of the inflatable bladder is substantially parallel to the centerline 705 of the directional sleeve.

Figure 8:
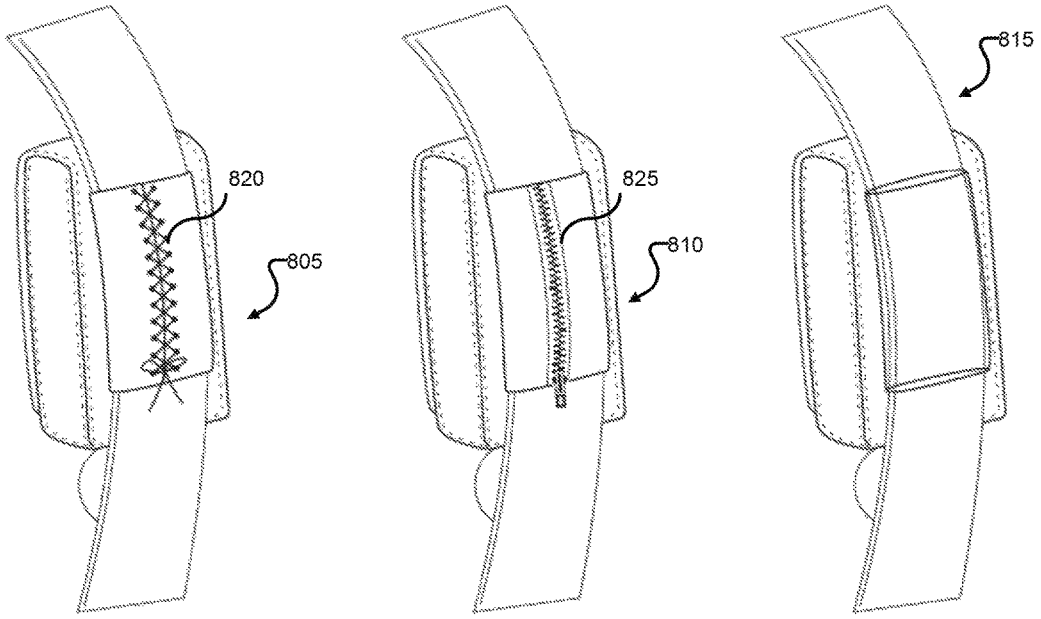
FIG. 8 illustrates three examples of removable directional attachment rigs according to various embodiments of this disclosure.

FIG. 8 illustrates three examples of removable directional attachment rigs, 805, 810 and 815 according to various embodiments of this disclosure.

According to the non-limiting example of FIG. 8, a first example of a removable directional attachment rig 805 includes a directional sleeve having at least two halves fastenably connected by lacing 820.

As shown in the non-limiting example of FIG. 8, a second example of a removable directional attachment rig 810 includes a directional sleeve having at least two halves fastenably connected by a zipper 825.

As shown in the non-limiting example of FIG. 8, a third example of a removable directional attachment rig 815 includes a seamless, unitary directional sleeve.

While not shown in FIG. 8, other embodiments of fastening members for portions of a directional sleeve are possible and within the intended scope of this disclosure. For example, suitable fastening members include, without limitation, hook-and-loop type fasteners, buttons and snaps.

Figure 9:
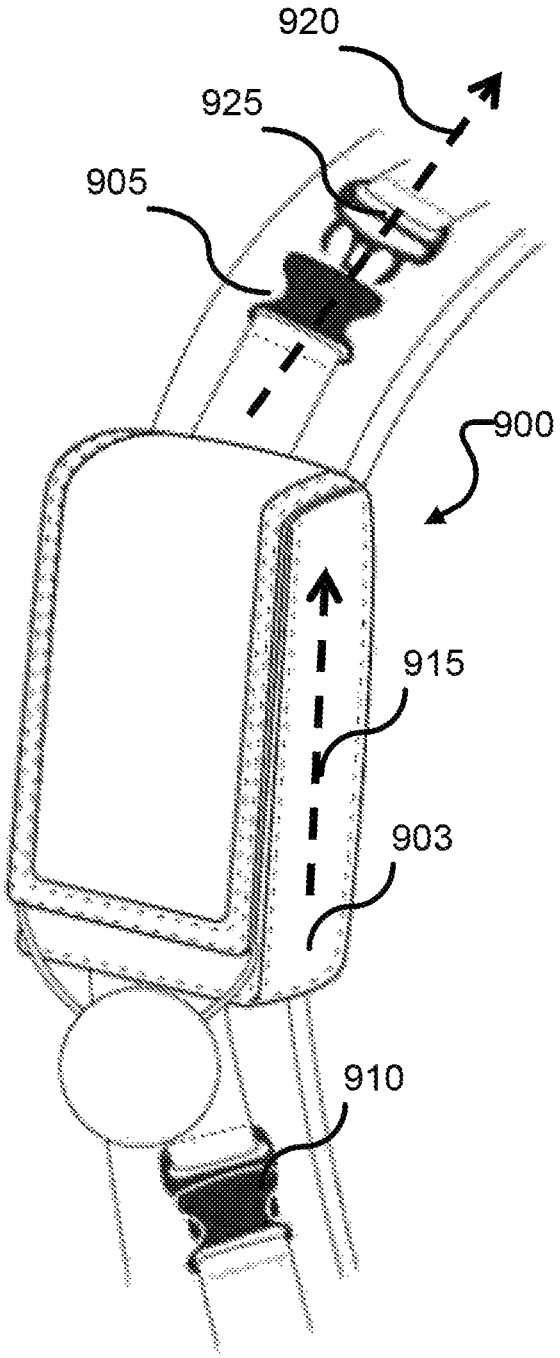
FIG. 9 illustrates a removable directional attachment rig for an inflatable bladder according to various embodiments of this disclosure.

FIG. 9 illustrates a directional attachment rig 900 according to various embodiments of this disclosure. As shown in the non-limiting example of FIG. 9, directional attachment rig 900 comprises a compartment 903 for an inflatable bladder, a first attachment anchor 905 and a second attachment anchor 910. As shown in the non-limiting example of FIG. 9, first attachment anchor 905 comprises the female half of a side release buckle connected by a length of webbing to compartment 903. Further, according to certain embodiments, first attachment anchor 905 is disposed along a line 920 that is substantially parallel to the direction of inflation 915 of an inflatable bladder. According to certain embodiments, the line upon which first attachment anchor 905 is disposed may be drawn by connecting the point at which first attachment anchor connects to the rest of directional attachment rig to the point where the first attachment anchor connects to the platform (in this case, the male portion 925 of a side release buckle). In some embodiments, instead of a part of a side release buckle, first attachment anchor may comprise a snap, a carabiner, a Velcro® strap or a ladder lock buckle.

According to certain embodiments, directional attachment rig 900 comprises a second attachment anchor 910, which in the non-limiting example shown in FIG. 9, comprises the female half of a second side release buckle. According to some embodiments, directional attachment rig 900 does not include a second attachment anchor. According to other embodiments, directional attachment rig 900 includes two or more second attachment anchor(s), of one or more types, including without limitation, a surface anchor, a directional sleeve, a snap, a carabiner, a Velcro® strap or a ladder lock buckle.

Figure 10:
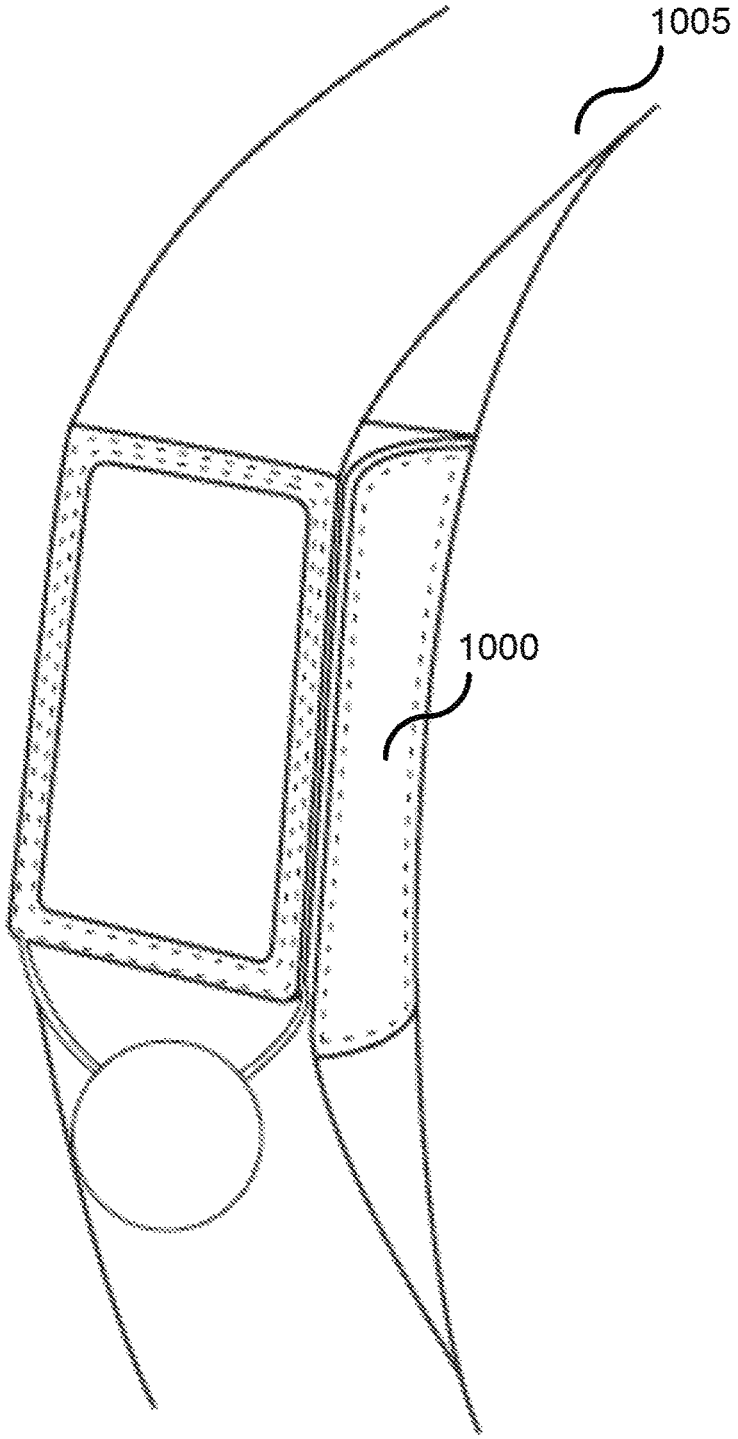
FIG. 10 illustrates a removable directional attachment rig for an inflatable bladder according to some embodiments of this disclosure.

FIG. 10 illustrates an example of a removable directional attachment rig 1000 according to various embodiments of the present disclosure. As shown in the non-limiting example of FIG. 10, according to some embodiments, removable directional attachment rig 1000 may be attached to a platform by an attachment anchor 1005, comprising a section of webbing or similar material which fastens to the platform using a surface mount, collar or other attachment means. According to certain embodiments, attachment anchor 1005 may be fashioned of a material chosen to match, or appear integrated with one or more suitable platforms (such as packs, vests or harnesses).

Figure 11:
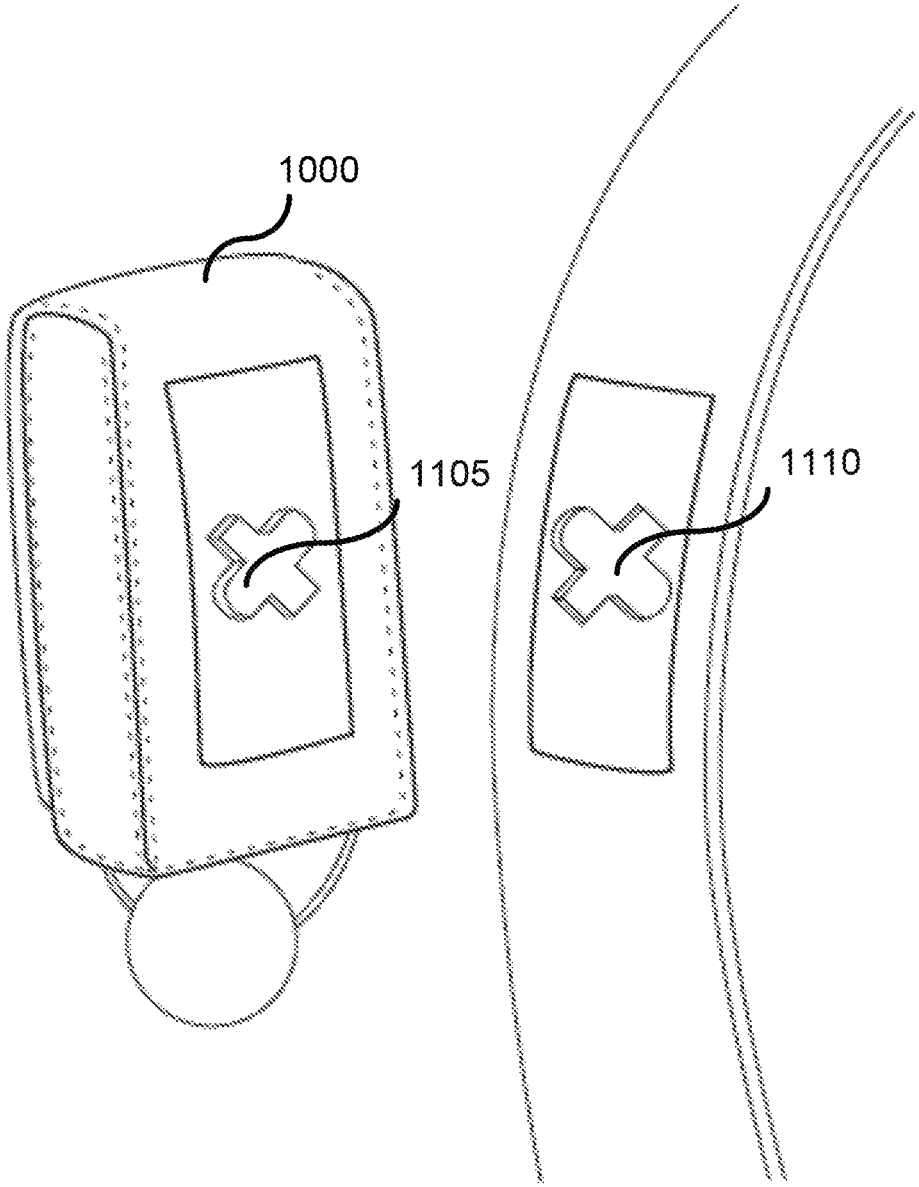
FIG. 11 illustrates two views of a removable directional attachment rig for an inflatable bladder according to certain embodiments of this disclosure.

FIG. 11 illustrates an example of a removable directional attachment rig 1100 according to certain embodiments of this disclosure. As shown in the non-limiting example of FIG. 11, removable directional attachment rig 1100 includes a surface anchor 1105 which connects to a mating member 1110 on the platform. According to certain embodiments, surface anchor 1105 comprises part of a single snap capable of resisting torque and maintaining the directionality of the removable directional attachment rig 1100. According to other embodiments, surface anchor 1105 may comprise part of a snap along with a high-friction material capable of resisting torque and maintaining the directionality of removable directional attachment rig 1100. According to still further embodiments, surface anchor 1105 comprises a section of hook or loop material, or lacing.

Figure 12:
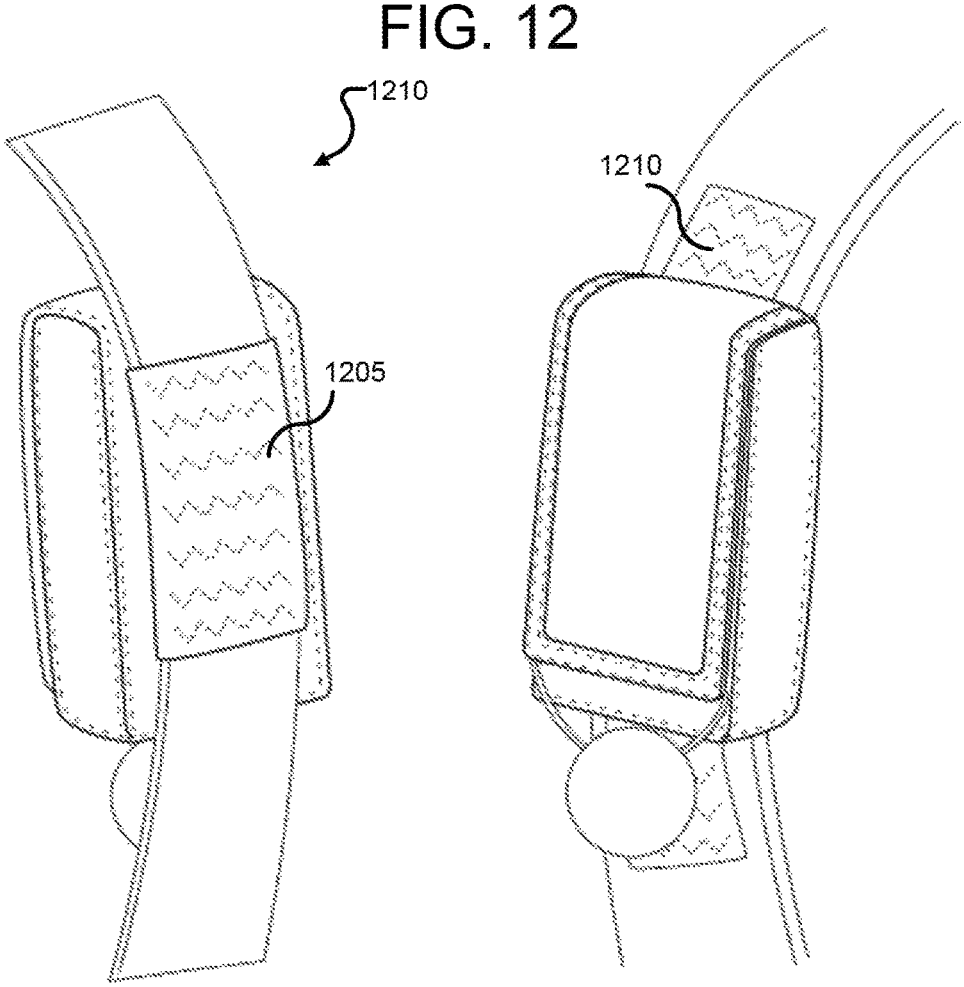
FIG. 12 illustrates a removable directional attachment rig for an inflatable bladder according to various embodiments of this disclosure.

FIG. 12 illustrates an example of a removable directional attachment rig 1200 according to various embodiments of this disclosure. As shown in the non-limiting example of FIG. 12, removable directional attachment rig 1200 supports multiple modes of attachment to a platform. In one mode of attachment, removable directional attachment rig 1200 is attached, via a directional sleeve 1205 to a strap (for example, a shoulder strap of a pack, or an external strap, such as used to compress, or "draw in" and internal frame pack). As shown in FIG. 12, the exterior of directional sleeve

1205 may comprise a surface anchor, such as a section of hook or loop material, or a set of snaps. Additionally, according to various embodiments, the interior surface of directional sleeve 1205 may comprise a high-friction material, such as a rubber paint, to resist sliding and maintain a correct mounting position on the platform. According to another mode of attachment, removable directional attachment rig 1200 may attach via a surface anchor to a suitable surface 1210 provided on the platform. In this way, certain embodiments of removable directional attachment rig 1200 may be both platform-agnostic, and designed for convenient use with a specific platform.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. A platform-agnostic buoyancy aid comprising:

a bladder having a direction of inflation;

an inflator coupled to the bladder;

a trigger connected to the inflator and configured to actuate the inflator in response to a tension applied to a ripcord; and a removable directional attachment rig holding the bladder, inflator and trigger, the removable directional attachment rig configured to removably attach the platform-agnostic buoyancy aid to a wearing platform comprising at least one of a backpack, clothing or harness, such that a relative angle of the direction of inflation of the bladder to a centerline of a wearer of the wearing platform remains substantially constant, wherein the inflator is configured to fill the bladder with a gas in response to actuation by the trigger.

2. The platform-agnostic buoyancy aid of claim 1, wherein the removable directional attachment rig further comprises an attachment sleeve having a centerline substantially parallel to the direction of inflation of the bladder.

3. The platform-agnostic buoyancy aid of claim 2, wherein the attachment sleeve further comprises two halves coupled by a fastening member.

4. The platform-agnostic buoyancy aid of claim 1, wherein the removable directional attachment rig comprises a pair of anchors disposed along a line substantially parallel to the direction of inflation of the bladder.

5. The platform-agnostic buoyancy aid of claim 1, wherein the removable directional attachment rig comprises a surface anchor.

6. The platform-agnostic buoyancy aid of claim 5, wherein the surface anchor comprises at least one of one or more pieces of hook or loop material, an interlocking member, lacing or part of a snap.

7. The platform agnostic buoyancy aid of claim 1, further comprising a grab ball attached to the ripcord.

8. A directional attachment rig for an inflatable bladder comprising:

a compartment comprising an anchor for the inflatable bladder and an opening disposed away from the anchor for the inflatable bladder;

a trigger portal; and a directional sleeve having a centerline that remains at a substantially constant angle relative to a direction of inflation of the inflatable bladder, wherein the directional sleeve is configured to removably attach the directional attachment rig to a wearing platform comprising at least one of a pack, article of clothing or harness, such that a relative angle of the direction of inflation of the inflatable bladder to a centerline of a wearer of the wearing platform remains substantially constant.

9. The directional attachment rig of claim 8, wherein the directional sleeve further comprises two halves connected by a fastening member.

10. The directional attachment rig of claim 9, wherein the fastening member comprises at least one of one or more pieces of hook or loop material, a zipper or lacing.

11. The directional attachment rig of claim 8, wherein an interior surface of the directional sleeve comprises section of material configured to create friction between the directional sleeve and the wearing platform to resist sliding.

12. The directional attachment rig of claim 8, further comprising an attachment anchor disposed along a line substantially parallel to the direction of inflation of the inflatable bladder.

13. The directional attachment rig of claim 9, further comprising a ripcord with a grab ball attached to the ripcord.

14. A directional attachment rig for an inflatable bladder comprising:

a compartment comprising an anchor for the inflatable bladder and an opening disposed away from the anchor for the inflatable bladder;

a trigger portal; and an attachment anchor disposed along a line that remains at a substantially constant angle relative to a direction of inflation of the inflatable bladder, wherein the attachment anchor is configured to removably attach the directional attachment rig to a wearing platform comprising at least one of a pack, article of clothing or harness, such that a relative angle of the direction of inflation of the inflatable bladder to a centerline of a wearer of the wearing platform remains substantially constant.

15. The directional attachment rig of claim 14, further comprising a second attachment anchor disposed along a line substantially parallel to the direction of inflation of the inflatable bladder.

16. The directional attachment rig of claim 14, wherein the attachment anchor comprises a surface anchor.

17. The directional attachment rig of claim 14, further comprising a directional sleeve having a centerline substantially parallel to the direction of inflation of the inflatable bladder.

18. The directional attachment rig of claim 14, wherein the attachment anchor comprises at least one of a part of a side release buckle, a carabiner, one or more sections of hook or loop material, or a ladder lock buckle.

19. The directional attachment rig of claim 14, further comprising a ripcord with a grab ball attached to the ripcord.

20. The directional attachment rig of claim 19, further comprising an avalanche beacon actuated by the ripcord.

* * * * *